US009999911B2

(12) United States Patent
Walter et al.

(10) Patent No.: US 9,999,911 B2
(45) Date of Patent: Jun. 19, 2018

(54) METHOD AND SYSTEM FOR CONTROLLING THE QUALITY OF A STAMPED PART

(71) Applicant: Toyota Motor Engineering & Manufacturing North America, Inc., Erlanger, KY (US)

(72) Inventors: Joshua A.H. Walter, Innerkip (CA); Michael J. Gravis, Woodstock (CA); Charles David Apps, Livermore, CA (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 767 days.

(21) Appl. No.: 14/571,845

(22) Filed: Dec. 16, 2014

(65) Prior Publication Data

US 2015/0107320 A1 Apr. 23, 2015

Related U.S. Application Data

(62) Division of application No. 13/041,857, filed on Mar. 7, 2011, now abandoned.

(51) Int. Cl.

| | |
|---|---|
| ***B21C 51/00*** | (2006.01) |
| ***B21J 9/20*** | (2006.01) |
| ***B21D 22/02*** | (2006.01) |

(52) U.S. Cl.

CPC ..... *B21C 51/005* (2013.01); *B21C 51/00* (2013.01); *B21D 22/02* (2013.01); *B21J 9/20* (2013.01)

(58) Field of Classification Search

CPC ... B30B 15/0094; B30B 15/281; B21D 22/02; B21D 24/02

See application file for complete search history.

(56) References Cited

U.S. PATENT DOCUMENTS

| | | | | |
|---|---|---|---|---|
| 4,121,289 | A | 10/1978 | Stiel | |
| 4,719,586 | A | 1/1988 | Moyer et al. | |
| 4,750,131 | A * | 6/1988 | Martinez | B30B 15/0094 700/206 |
| 5,311,759 | A | 5/1994 | Mangrulkar et al. | |
| 5,423,199 | A | 6/1995 | Mangrulkar | |
| 5,440,478 | A | 8/1995 | Fisher et al. | |
| 5,448,902 | A * | 9/1995 | Thoms | B21D 5/004 72/31.13 |
| 5,622,069 | A | 4/1997 | Walters | |
| 5,631,851 | A | 5/1997 | Tanaka et al. | |
| 5,692,404 | A | 12/1997 | Kirii et al. | |

(Continued)

FOREIGN PATENT DOCUMENTS

WO 2007022755 A2 3/2007

*Primary Examiner* — Matthew G Katcoff
(74) *Attorney, Agent, or Firm* — Dinsmore & Shohl LLP

(57) ABSTRACT

A system and method for detecting a defective part and the type of defect formed during stamping operations. The system and method will not only detect the defect but also the nature of the defect and the time at which the defect occurred during stamping operations. Such information is useful not only in quality control but also in isolating a problem which may exist in stamping operations and thus eliminating time for isolating such problems and correcting them. The system and method uses a profile of a properly stamped part to detect a defect, and the root cause of the defect.

9 Claims, 6 Drawing Sheets

(56) References Cited

U.S. PATENT DOCUMENTS

| | | | | |
|---|---|---|---|---|
| 5,724,843 | A | 3/1998 | Kirii et al. | |
| RE35,996 | E | 12/1998 | Rasmussen | |
| 6,095,307 | A | 8/2000 | Hamulak et al. | |
| 6,353,802 | B1 | 3/2002 | Barbur et al. | |
| 6,415,191 | B1 | 7/2002 | Pryor | |
| 6,445,969 | B1 | 9/2002 | Kenney et al. | |
| 6,467,356 | B1 | 10/2002 | Schoch | |
| 6,748,647 | B1 | 6/2004 | Fox et al. | |
| 7,181,355 | B2 | 2/2007 | Kondo et al. | |
| 7,209,846 | B2 | 4/2007 | Tamaki et al. | |
| 7,530,250 | B2 | 5/2009 | Hartung et al. | |
| 2006/0107724 | A1 | 5/2006 | Iwashita et al. | |
| 2007/0006630 | A1* | 1/2007 | Iwashita ..... | B21D 24/02 72/351 |
| 2008/0066515 | A1 | 3/2008 | Iwashita et al. | |
| 2008/0092620 | A1* | 4/2008 | Suzuki ..... | B21D 24/10 72/343 |
| 2009/0120151 | A1 | 5/2009 | Kuwayama et al. | |
| 2009/0126453 | A1 | 5/2009 | Suzuki | |

* cited by examiner

A Method for Detecting a Defect in a Part Stamped from a Blank of Material Formed by the Operation of a Die

METHOD AND SYSTEM FOR CONTROLLING THE QUALITY OF A STAMPED PART

CROSS-REFERENCE TO RELATED APPLICATIONS

This application is a divisional of U.S. patent application Ser. No. 13/041,857 filed on Mar. 7, 2011, which is incorporated in its entirety herein by reference.

FIELD OF THE INVENTION

The invention relates to a system for stamping a part from a blank of material. More particularly, the invention relates to a system and method for detecting abnormalities in the part stamped by a die using forces measured during stamping operations and comparing them with a profile of forces for a properly stamped part.

BACKGROUND OF THE INVENTION

Stamping operations are done using a die. The die includes an upper die and a lower die, also referenced herein as a slide press and a die cushion respectively. A sheet of material, also referenced in the art as a blank, is placed between the slide and die cushion and the slide and die cushion are pressed against each other so as to form the blank into a desired part.

The part may then be visually inspected to ensure that no abnormalities existed during stamping operations. As visual inspection may be time consuming and subject to human error, systems have been put in place to make the inspection automated.

For instance, it is known to use the displacement of the press with respect to stamping operations to determine whether or not any flaws occurred during stamping operations. Other methods include measuring compressive and tensile forces on the production part. However, these methods do not take into account the work and force peaks which are transmitted during the stamping operation and thus will not determine the type of the flaw that has occurred. Further, such methods and systems do not provide the type of defect present in the stamped part.

Accordingly, it remains desirable to have a system which not only detects whether or not the part is defective but will also provide the type of flaw that occurred thus allowing for operators and management to reconfigure stamping operations to eliminate the flaw. For example, if it is detected that the machine has produced parts which have wrinkles, then the forming characteristics of the forces with respect to time may direct the user as to where in the forming process the wrinkles have been formed.

SUMMARY OF THE INVENTION

The present invention provides a system and method for detecting a defective part and the type of defect formed during stamping operations. The system and method will not only detect the defect but also the nature of the defect and the time at which the defect occurred during stamping operations. Such information is useful not only in quality control but also in isolating a problem which may exist in stamping operations and thus eliminating time for isolating such problems and correcting them.

The method includes the step of establishing a profile. The profile includes characteristics of forces of a properly stamped part. Such characteristics include peak forces applied by the die with respect to a particular point in time during stamping operations. Stamping operations as used herein refers to the process by which die parts are moved together to press a blank and are released from each other so as to free the blank for use in manufacturing.

The method further includes the step of measuring the forces of the stamped blank of material and comparing the force characteristics of each of the stamped blanks of material with the profile of the properly stamped part. The profile may further include defective profiles, the defective profile being a profile of an improperly formed part having a particular defect. The defective profiles may include force characteristics for a part formed with a wrinkle, or a split. The existence of the wrinkle or split may be analyzed to determine the root cause of the defect. This root cause may be recorded as part of the defective profile. For instance, a wrinkle may be formed for numerous reasons; however, a particular reason may have a unique force characteristic. Once the root cause is determined, the identified root cause is then associated with that particular wrinkle.

The force characteristics of various defects, to include the location of the defect within the part may be recorded and used to for a respective defective profile. Thus, operators overseeing stamping operations may be able to not only identify that the part is defective but the location and nature of the defect. Further, the die operators may be able to easily recognize the root cause of the defect and take corrective measures to minimize manufacturing loss.

A system for controlling the quality of a stamped part from a blank of material is also provided. The system includes a die having a slide press and a cushion press. A sensor is mounted to the die and is operable to detect the forces applied to the blank of material. A database having a profile including characteristics of forces of a properly stamped part is used to compare the forces measured during stamping operations.

The profile may further include defective profiles. Each of the defective profiles having characteristics of forces which identify the nature of the defect. A processor is in communication with the sensor. The processor compares the forces detected during the stamping of a part and labels the part defective when the detected forces deviate from the profile of the properly stamped part. The processor may further search the database for a defective profile which matches the detected profile so as to identify the nature of the defect.

DETAILED DESCRIPTION OF THE INVENTION

Figure 1:
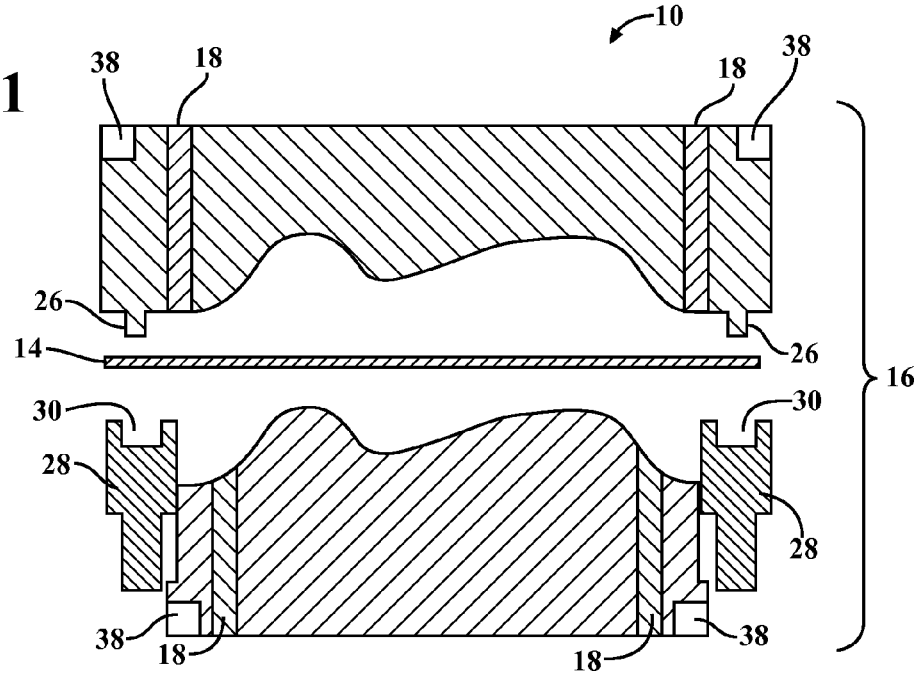
FIG. 1 is a cross-sectional view of a die and a blank.

Referring to FIGS. 1-8, a system 10 for controlling the quality of a part 12 stamped from a blank of material 14 is provided. The system 10 includes at least one die 16 operable to stamp the blank of material 14 into a desired part 12. A sensor 18 monitors the forces exerted by the die 16. The forces are compared to a profile 20. The profile 20 includes the forces generated during a stamping operation of a properly formed part 12. The profile 20 shows the proper distribution of forces with respect to time. The system 10 labels a part 12 defective when the forces measured differ a predetermined amount from the profile 20.

Figure 2:
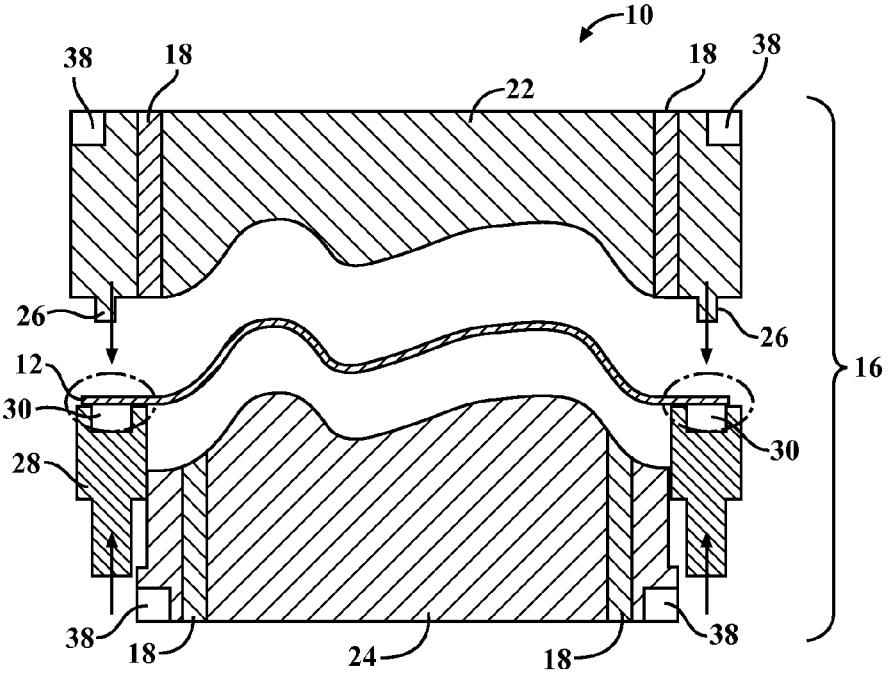
FIG. 2 is a cross-sectional view of FIG. 1 showing the blank being formed.

With reference first to FIGS. 1 and 2, an operation of the die 16 is provided. The die 16 has an upper die 22 and a lower die 24, referenced herein as a slide press 22 and a die cushion 24 respectively. The slide press 22 includes tabs 26. The tabs 26 are shown on opposing sides of the slide press 22. The die 16 further includes a pair of binders 28 each having a catch 30. The die cushion 24 is disposed between respective binders 28. The tabs 26 and binders 28 are respectively aligned with each other.

The surfaces of the slide press 22 and cushion press 24 are configured to form a predetermined part 12 from a blank. With reference first to FIG. 1, the blank is shown disposed between the slide press 22 and the cushion press 24. The slide press 22 and cushion press 24 are pressed towards each other. The tabs 26 are seated within the catches 30 of the binder 28 and the blank is held in place. The slide press 22 and cushion press 24 are then displaced towards each other so as to stamp the blank of material 14 into a desired part 12. With reference now to FIG. 2, the slide press 22 and cushion press 24 are moved away from each other and the part 12 may then be taken from the die 16.

Figure 3A:
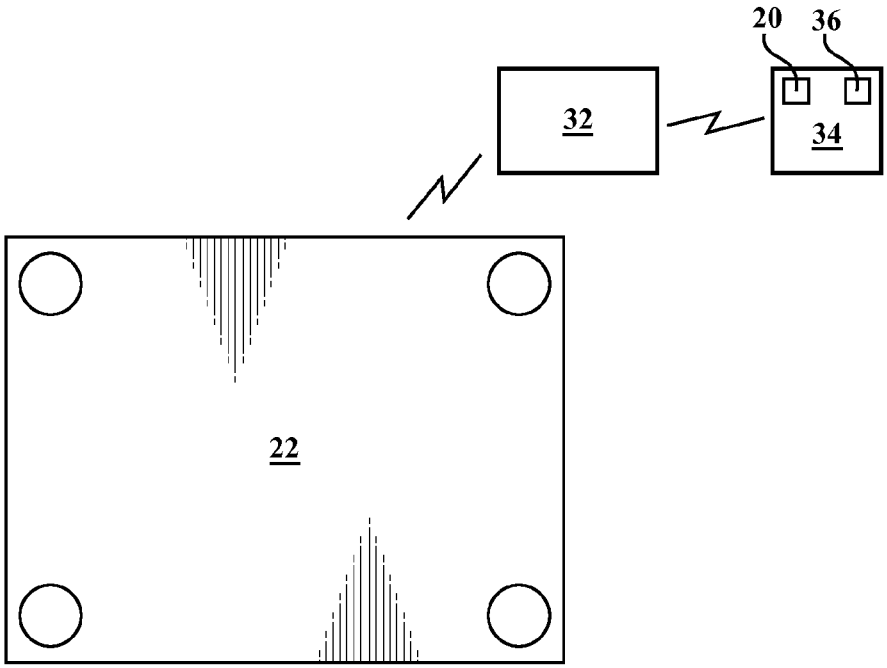
FIG. 3A is an overhead view of the upper die showing sensors formed at each corner.
Figure 3B:
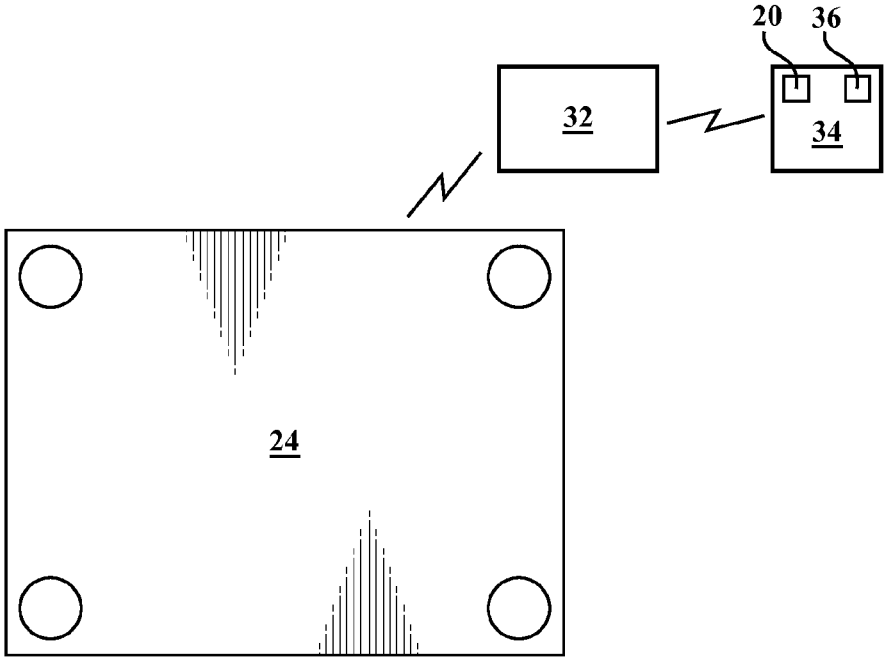
FIG. 3B is a view taken from the bottom of the cushion press showing sensors mounted at each corner of the die cushion.

With reference now to FIGS. 3A and 3B, the sensors 18 are shown mounted to respective slide and cushion presses. The sensors 18 are in communication with the processor 32. Preferably the sensors 18 are mounted to the corners of the presses. Such sensors 18 are currently known and used and illustratively include a connection screw. Force is transmitted through the connection screw to the processor 32.

A database 34 having a profile 20 of characteristic forces of a properly stamped part 12 may be used to compare forces detected during the stamping of a part 12 to determine the existence of a defect. The profile 20 may be formed through the manufacture of a desired part 12. Specifically, the force characteristics of the part 12 may be collected and compared so as to create the profile 20. Thus the profile 20 may be a historical record of stamped parts 12 which were formed properly. The profile 20 may include force characteristics for both the slide press 22 and the cushion press 24.

As used herein, force characteristics relates to the amount of force measured with respect to time, displacement of respective slide and cushion presses with respect to time, and the amount of work done with respect to time. Thus, not only does the profile 20 include the amount of force, but a point along time in which the force was experienced, how much work was done to stamp the part 12, and the whether the slide and cushion presses were in proper position throughout the stamping operation.

The profile 20 may further include defective profiles 36. The defective profiles 36 are force characteristics or force characteristics of a particular defect. Thus as parts 12 are stamped, particular defects are recorded. The force characteristics of those defects may be stored in the database 34 as a defective profile 36. For instance, if a part 12 is stamped with a wrinkle or a tear, the force characteristics of the defective part 12 is recorded and stored as a defective profile 36.

The processor 32 is in communication with the sensors 18. The processor 32 compares the forces detected during the stamping of the part 12 and compares those forces with the profile 20 of a properly stamped part 12. If the profile 20 matches the detected forces, then the part 12 is identified as being properly formed. If the detected forces do not match the profile 20, then the part 12 is labeled as defective. In cases where a part 12 is labeled defective, the processor 32 further searches the database 34 to determine if the detected forces match any one of the defective profiles 36. Detected forces corresponding to a defective profile 36 is then used to identify the nature of the defect. The processor 32 may further compare other aspects of the stamping operation to the profile 20, to include the work done on the part 12 and the position of the slide and cushion presses with respect to time.

The system 10 further includes an encoder 38. The encoder 38 may be disposed on either the slide press 22 or the die cushion 24. The encoder 38 is operable to detect the position of the respective slide or cushion press 22, 24 during stamping operations.

Figure 4:
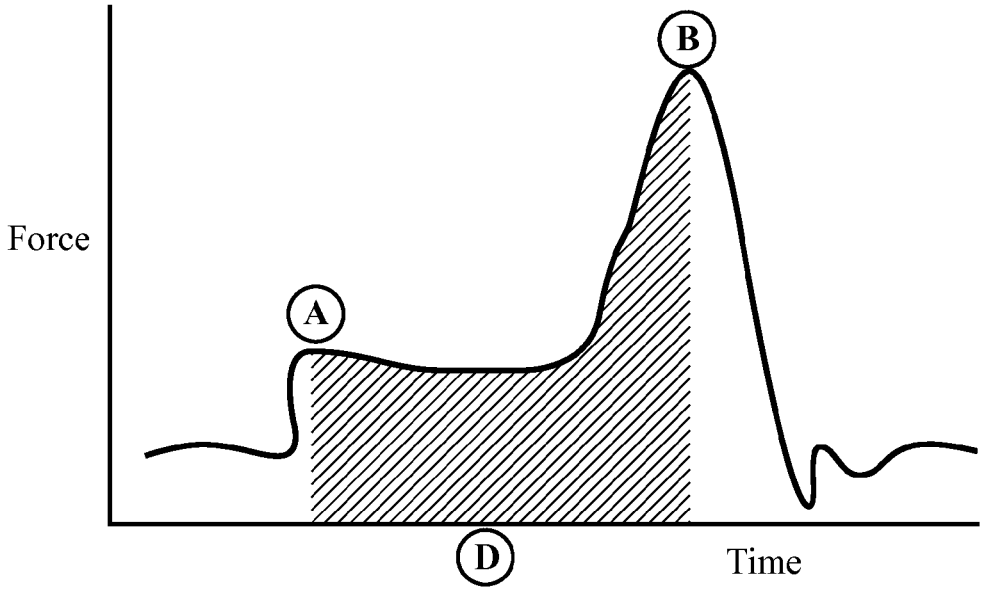
FIG. 4 shows a profile of the forces of a properly formed part for the slide press.
Figure 5:
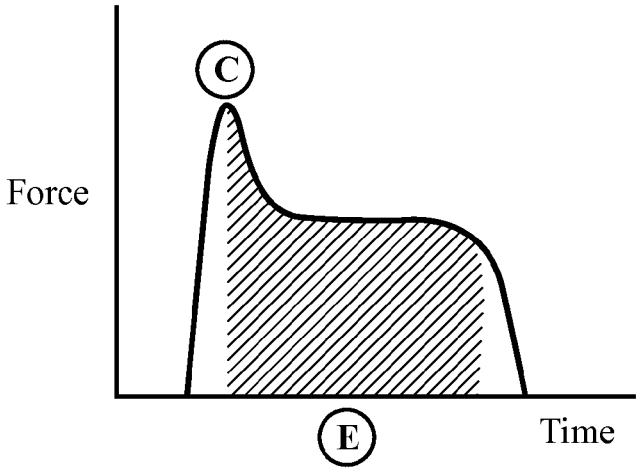
FIG. 5 shows a profile of a properly formed part with respect to the die cushion.

With reference now to FIGS. 4 and 5, the profile 20 of a properly stamped part 12 with respect to the slide press 22 and cushion press 24 are provided. The forces are measured with respect to position.

As shown, there are peak forces which occur during stamping operations respectively labeled A, B and C. Peak forces indicated by references A and B show the peak forces applied by the slide press 22, whereas peak force labeled C is the peak force applied by the cushion press 24. These force characteristics indicate characteristics which are acceptable for a properly formed part 12.

The profiles 20 further include the work done by the respective slide and cushion presses as indicated in the lined portion shown in FIGS. 4 and 5. Thus the profile 20 not only includes identifying when these peak forces are formed with respect to the stamping operations but also how much work each press has done on the part. These five characteristics (the three peak forces and work done by each press) are used to indicate that the part 12 was properly formed. It should be appreciated that these characteristics exemplify a proper forming condition. However, as will be discussed later, other forces and inputs may be used to further narrow what is acceptable as a properly formed part 12.

Figure 6:
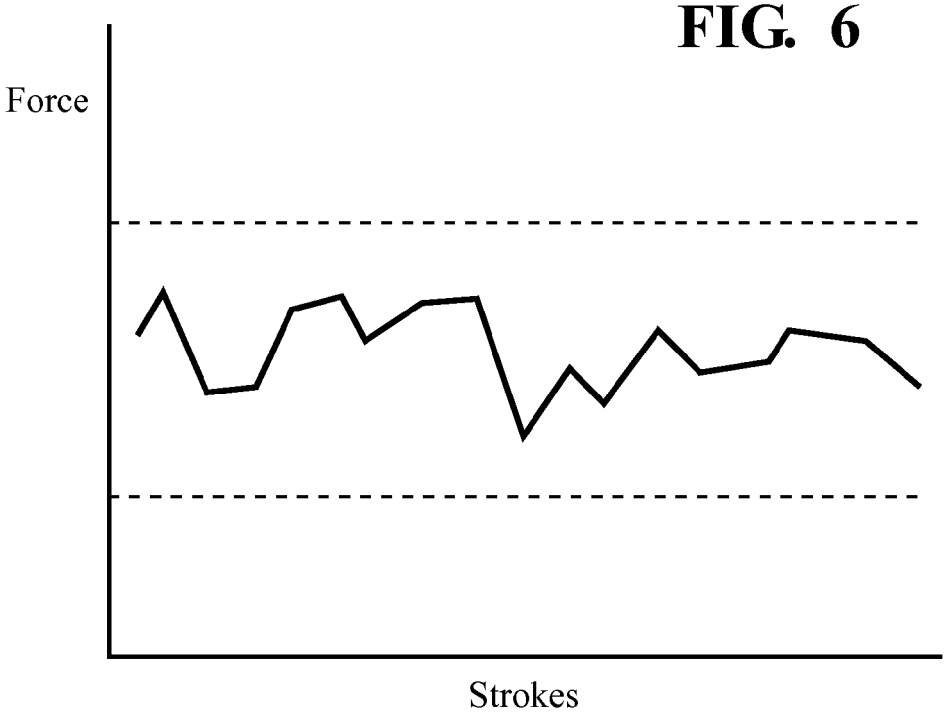
FIG. 6 is a chart showing the characteristics of forces with respect to the strokes of the die.
Figure 7:
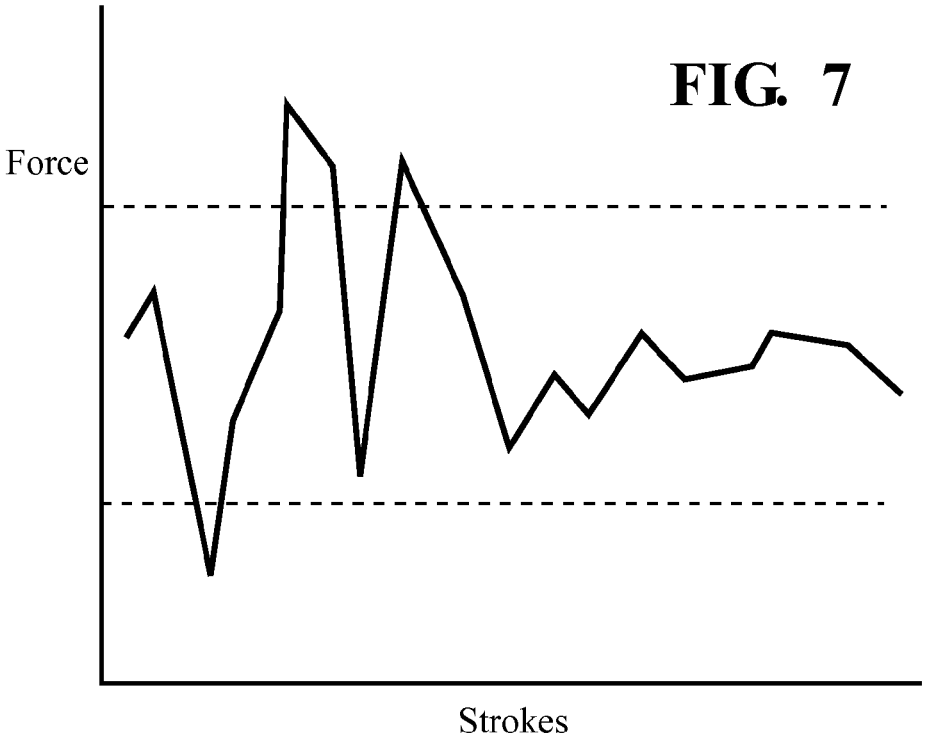
FIG. 7 is a chart showing forces outside of the force parameters indicating a defect.
Figure 8:
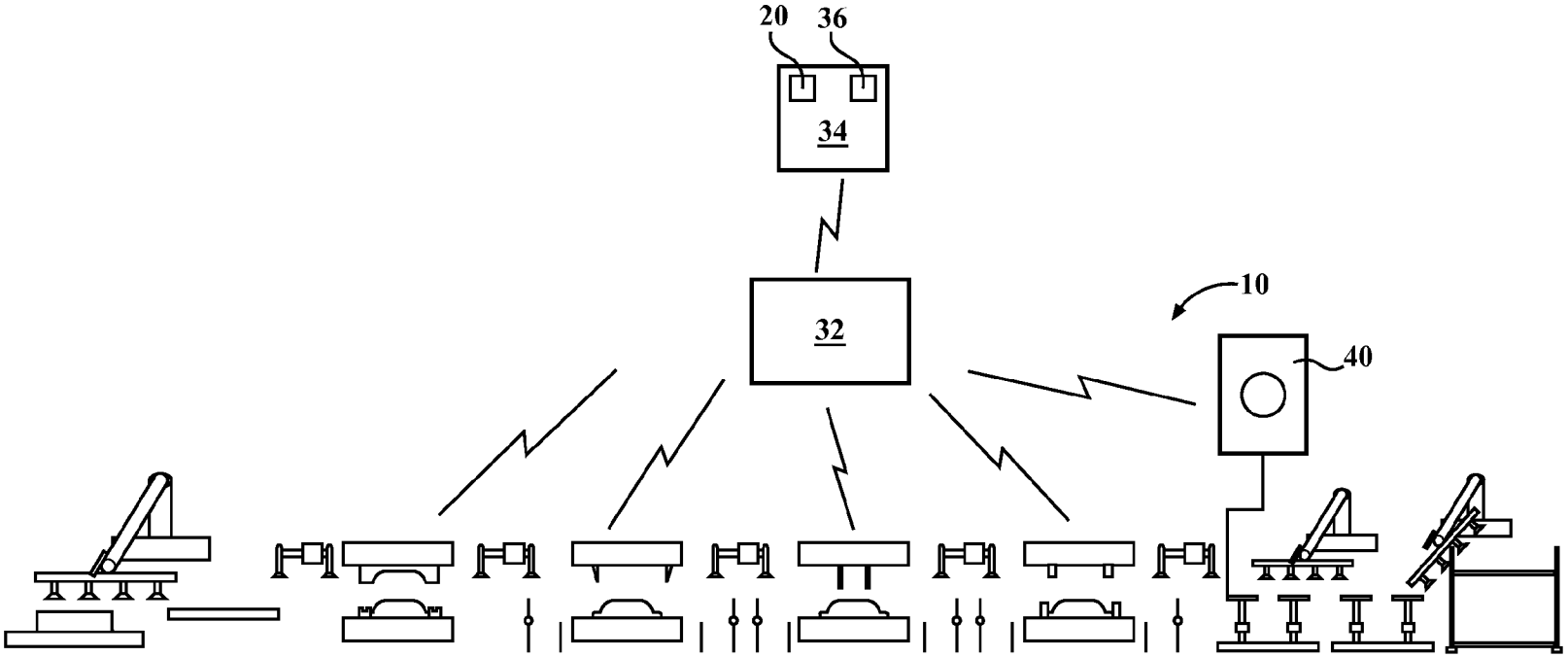
FIG. 8 is a perspective view of a manufacturing line showing the stamping operations of a part.

With reference now to FIGS. 6, 7 and 8, a chart showing the forces with respect to the strokes performed by dies 16 placed in succession is provided. FIG. 6 shows a proper profile 20 for the operation of a plurality of dies 16 with respect to the force characteristics and the strokes or presses of the die 16 function. Strokes as used herein refers to the displacement of a slide and cushion press 22, 24 to and from each other.

With reference to FIG. 6, a force parameter is provided. The force parameter is indicated by the dashed lines found above and beneath the profile 20. The force parameter is a threshold of acceptable forces during stamping operations. With reference now to FIG. 7, the forces measured during the stamping process of a part 12 is shown. The profile 20 is created by the forces detected by the sensor 18 and transmitted to the processor 32 and processed. In this case it may be seen that there are three instances in which the forces exceed or are outside of the force parameters as defined by the dashed lines. In such a case the system 10 may be shut down.

The profile 20 includes peak forces of the slide and cushion presses with respect to time and as stated below, the work performed by both the slide and the cushion presses. However, the profile 20 may also take into account various inputs such as the position of the slide and cushion presses during the stamping operations with respect to time and whether or not oil was placed on the presses or the blank. Other inputs may further include the temperature of the die 16 or the slide and cushion presses or the temperature of the blank for that matter. Thus, a profile 20 of force characteristics for a properly stamped part 12 having a thin film of oil, or without oil may be recorded and used to detect defective parts 12.

Thus the profile 20 may be one of many that the user may select based upon the part 12 being stamped, the material used in the blank, and the temperature of the die 16, or whether or not a film of oil was used. The measured forces are compared to the selected profile 20 to determine whether the stamping process produced an abnormal or defective part 12.

With reference now to FIG. 8, an operation of the system 10 is provided. The system 10 includes a plurality of dies 16 disposed downstream a steel blank feeder. The steel blank feeder collects blanks and positions them in between the press and cushion slides. Once the blank of material 14 is fed, the slide and cushion presses are displaced towards one another and the tabs 26 of the slide press 22 engage the binders 28 so as to hold the blank in position during forming operations.

As the presses are pressed towards one another, the forces exerted by the presses are measured by the sensors 18. The forces are measured throughout the stamping operation of a respective die 16, which is until the presses are displaced from each other. The blank of material 14 is fed downstream the line through each of the dies 16. In the instant case three other die 16 presses are shown downstream the initial die 16. Each die 16 press will have a profile 20 that is characteristic for the work that the die 16 is to do on the blank of material 14. Thus the system 10 may be operable to detect a defective part 12 in any of the die 16 forming processes.

Not only is the system 10 capable of detecting a defect, the system 10 may be operable to detect the nature of the defect if a defective profile 36 matches a force characteristic of a formed part 12. The system 10 may further include an automatic shut-off 40 operable to cease operations of the die 16. The automatic shut-off may be actuated when the detected forces deviate from the profile 20 of the properly stamped part 12. With reference to FIG. 8, the automatic shut-off is a button in electrical communication with the system 10. The automatic shut-off 40 may be manually actuated by a press of a button, or may be actuated by the processor depending upon the type or number of defects occurring along the line.

An indication as to the nature of the defect may be provided wherein the detected forces match one of the defective profiles 36 stored in the database 34. The existence of the wrinkle or tear may be analyzed to determine the root cause of the defect. This root cause may be recorded as part 12 of the defective profile 36. For instance, a wrinkle may be formed for numerous reasons; however, a particular reason may have a unique force characteristic. Once the root cause is determined, the identified root cause is then associated with that particular wrinkle. Identification of the root cause may reduce manufacturing loss by allowing the operator to go right to the source of the error as opposed to trouble shooting the entire system 10.

Figure 9:
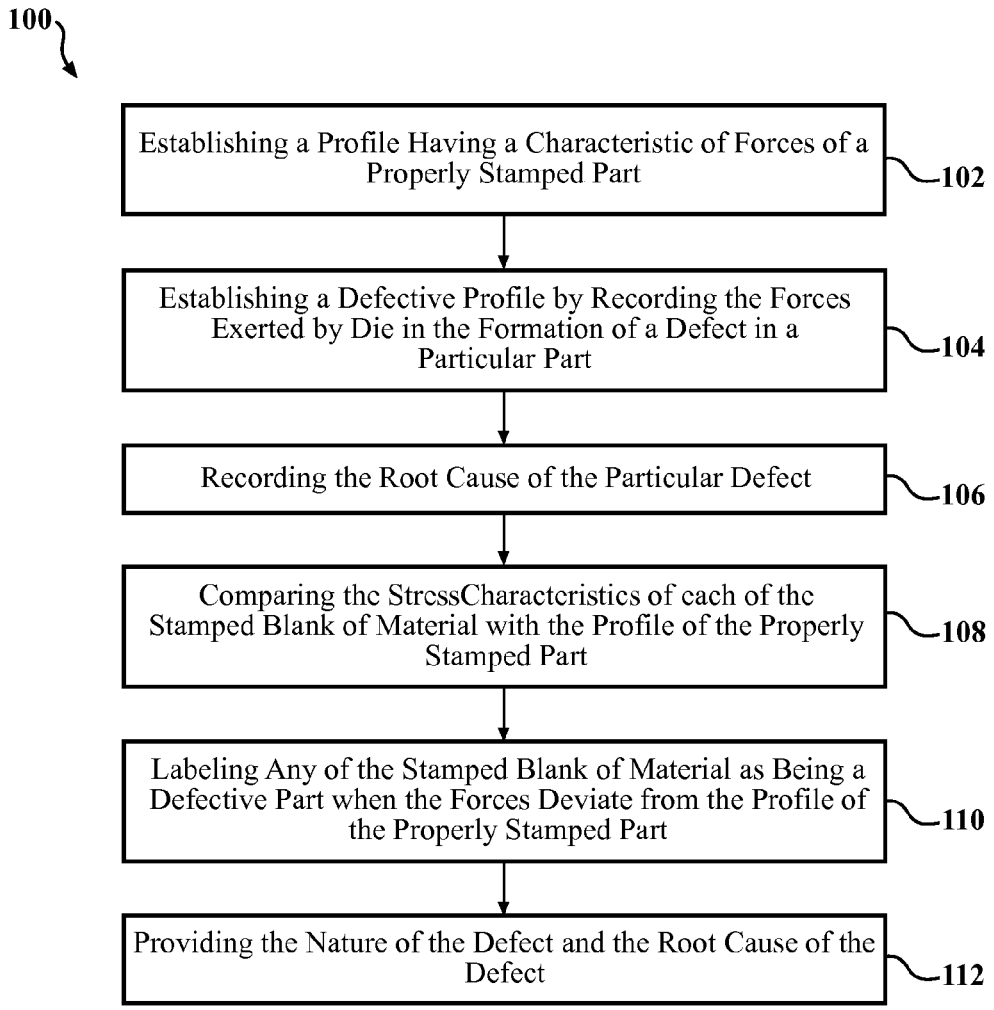
FIG. 9 is a diagram showing the steps of a method for detecting a defective part.

With reference now to FIG. 9, a method 100 for controlling the quality of a part 12 stamped from the blank of material 14 formed by the operation of a die 16 is provided. The method 100 includes the step of establishing a profile 20 at 102. The profile 20 has characteristics of forces of a properly stamped part 12. The profile 20 may be established by stamping a part 12 and determining if the part 12 meets design specifications and does not include any faults. The characteristic of forces of such a part 12 may be used as the profile 20.

The method 100 further includes the step of measuring the forces of a stamped blank of material 14 and comparing the stress characteristics of each of the stamped blank of material 14 with the profile 20 of the properly stamped part 12 at 108. The method 100 proceeds to step 110 where any of the stamped blank material is labeled as being a defective part 12 where the forces deviate from the profile 20 of the properly stamped part 12. The profile 20 may take into consideration the force of the slide and cushion presses and may include establishing a force parameter wherein stamped materials having slide and cushion press 22, 24 forces outside of the side force parameter are labeled as defective.

The method 100 may include using other inputs to further define a profile 20. For instance, the method 100 may include the use of the speed of the die 16 operation, the temperature of the die 16, or the existence of a film of oil on the blank of the material to establish the profile 20. Thus, a profile 20 for a properly formed part 12 at 100° Fahrenheit may have different force characteristics than that same part 12 properly formed at 80° Fahrenheit. Likewise, a profile 20 may have different force and force characteristics for the same part 12 where one part 12 is made with a film of oil and the other is not.

The method 100 may further include the step of establishing a defective profile 36 at. The defective profile 36 may be established by recording the forces exerted by the slide and cushion press 22, 24 in the formation of a defect in a particular part 12. For instance, the formation of a wrinkle in a part 12 may leave a unique force characteristic. The force characteristics of each of the stamped part 12 may be compared with the defective profiles 36, and the nature of the defect may be provided as shown at step 112.

The method 100 may further include the step of recording the root cause and associating the root cause with the defective profile 36 at 106. The root cause of the defect may be analyzed by die 16 operators. Thus the method 100 not only identifies a defect, but also provides the nature of the defect and the root cause.

In view of the teaching presented herein, it is to be understood that numerous modifications and variations of the present invention will be readily apparent to those of skill in the art. Likewise, the foregoing is illustrative of specific embodiments of the invention but is not meant to be a limitation upon the practice thereof. It is the following claims, including all equivalents, which define the scope of the invention.

We claim:

1. A method for detecting a defect in a part stamped from a blank of material formed by the operation of a die, the method comprising:

establishing a profile of a properly stamped part made during a stamping process, wherein the profile is established by sensing at least one force characteristic of the properly stamped part made over a predetermined period of time during the stamping process;

storing the profile in a database;

measuring the at least one force characteristic of a blank of material during the stamping process over the predetermined period of time;

comparing the at least one force characteristic of each of the blank of material made during the stamping process and over the predetermined period of time with the profile of the properly stamped part, wherein the at least one force characteristic of the blank of material is compared over the same predetermined period of time during the stamping process to the at least one force characteristic of the profile established during the predetermined period of time during the stamping process; and labeling any of the blank of material as being a defective part when the at least one force characteristic deviates from the profile of the properly stamped part during the stamping process.

2. The method as set forth in claim 1, wherein the die has a slide press and a cushion press, the profile of the properly stamped part includes the at least one force characteristic made within the predetermined period of time during the stamping process from a slide force sensed from the slide press and the at least one force characteristic made within the predetermined period of time during the stamping process from a die cushion force sensed from the cushion press.

3. The method as set forth in claim 2, further including the step of establishing a slide force threshold of the slide force, wherein the blank of material having the slide force outside of the slide force threshold within the predetermined period of time during the stamping process are labeled as defective.

4. The method as set forth in claim 2, further including the step of establishing a die cushion force threshold of the die cushion force, wherein the blank of material having the die cushion force outside of the die cushion force threshold within the predetermined period of time during the stamping process is labeled as defective.

5. The method as set forth in claim 1, further including the step of establishing the profile of the properly stamped part by sensing a speed of the die operation within the predetermined period of time during the stamping process.

6. The method as set forth in claim 1, further including the step of establishing the profile of the properly stamped part by sensing a temperature of the die within the predetermined period of time during the stamping process.

7. The method as set forth in claim 1, further including the step of placing a film of oil on the blank of material, and establishing the profile based upon the changes in the film of oil placed on the blank of material within the predetermined period of time during the stamping process.

8. The method as set forth in claim 1, further including the step of establishing a defective profile, the defective profile including the force characteristics of a defective part, and the nature of the defect.

9. The method as set forth in claim 8, wherein the defective profile further includes the root cause of the defect.

* * * * *